US005937453A

United States Patent [19]

Hodak et al.

[11] Patent Number: 5,937,453

[45] Date of Patent: Aug. 17, 1999

[54] POOL SKIMMER FACE PLATE AND RELEASABLE COVER

[75] Inventors: Frank J. Hodak, 1475 E. Cruikshank Rd., Valencia, Pa. 16059; Michael L. Hodak, Venetia, Pa.

[73] Assignee: Frank J. Hodak, Valencia, Pa.

[21] Appl. No.: 08/930,838

[22] PCT Filed: Feb. 6, 1997

[86] PCT No.: PCT/US97/01922

§ 371 Date: Jan. 27, 1998

§ 102(e) Date: Jan. 27, 1998

[87] PCT Pub. No.: WO97/29260

PCT Pub. Date: Aug. 14, 1997

[51] Int. Cl.[6] ..... E04H 4/00

[52] U.S. Cl. ..... 4/508

[58] Field of Search ..... 4/507–509; 220/793

[56] References Cited

U.S. PATENT DOCUMENTS 3,424,342 1/1969 Scopp et al. ..... 220/60
4,913,810 4/1990 Hodak ..... 210/169
4,951,326 8/1990 Barnes et al. ..... 4/494
5,285,538 2/1994 Hodak ..... 4/507

*Primary Examiner*—Charles E. Phillips
*Attorney, Agent, or Firm*—Webb Ziesenheim Logsdon Orkin & Hanson, P.C.

[57] ABSTRACT

A sealing assembly is provided for a swimming pool skimmer. The sealing assembly includes a rigid frame-shaped face plate (12) with a central opening and having a sealing flange (18) around its outer periphery and further has a protruding section outwardly extending from one side thereof which also includes a peripheral sealing flange. A detachable cover (2) is also provided which is made from a flexible plastic material. The cover (2) has a flat central portion for closing off the opening in the skimmer plate and carries a peripheral lip for engaging the sealing flange around the face plate. The cover (2) also includes a protruding section which carries a peripheral lip which overlays the protruding section of the face plate and engages the peripheral sealing flange thereof. The protruding section of the cover further includes a lifting tab (10) to provide a lever action for breaking the seal between the peripheral edge seal of the protruding sections for quick and easy removal of the cover from the face plate.

2 Claims, 3 Drawing Sheets

POOL SKIMMER FACE PLATE AND RELEASABLE COVER

BACKGROUND OF THE INVENTION

1. Field of the Invention

The present invention relates generally to swimming pools and more particularly to sealing apparatus for closing off the sidewall opening of a skimmer when the swimming pool is closed for the winter season, for example. It is common to employ one or more skimmer devices in the sidewalls of swimming pools, hot tubs and the like to permit surface water to be drawn off by a pump, filtered at a remote location and returned to the pool through one or more return ports. When the pool is closed during the winter season, it is sometimes desirable to maintain a level of water in the pool for structural purposes. In such cases, it is necessary to close off the skimmer to prevent backflow of water through the skimmer conduit to the filtration equipment so as to prevent damage to the pipes and filtration equipment due to freezing during the cold winter months.

2. Description of the Prior Art

One common way of closing off the skimmer is to employ an elongated plug-like element, marketed under the trademark "GIZMO". The plug element is threadably secured within the floor of the skimmer body to seal the conduit communicating with the pump and the filtration equipment. U.S. Pat. No. 4,913,810 to Jerry Hodak discloses a system for closing off a skimmer opening by providing a cover panel for securement onto an extra gasket frame which is specially fitted between the pool sidewall and the skimmer face plate. In order to use the device of U.S. Pat. No. 4,913,810, it is first necessary to physically remove the face plate from the skimmer and pool sidewall in order to install the special gasket frame therebetween. Needless to say, this requires extra labor and expense which may cause the average swimming pool owner to choose not to employ such a retrofit. The extra plate may also cause leakage if not properly installed. The invention disclosed in U.S. Pat. No. 5,285,538 to Frank J. Hodak, co-applicant herein, is directed to a sealing assembly for a skimmer opening which does not require the extra gasket frame called for in the above-cited, commonly owned patent, and therefore is much more reliable and easier to install. The cover member of the aforementioned U.S. Pat. No. 5,285,538 cooperates with the face plate of the skimmer to provide a much improved seal than heretofore possible in the prior art.

The present invention represents an improvement over U.S. Pat. No. 5,285,538 which is incorporated herein by reference. As stated, the sealing device of the aforesaid U.S. Pat. No. 5,285,538 provides an excellent seal around the skimmer opening. A problem develops, however, after the winter season when the water level has risen above the skimmer opening. In this condition, the water pressure acting against the face of the sealed skimmer cover forces the cover tightly against the skimmer face plate. In addition, algae growth over the pool sidewall and skimmer cover usually occurs over the dormant winter period, creating a slippery surface on the cover. The force of the water pressure, coupled with the slippery surface, as well as the tight snap fit around the periphery of the skimmer face plate, makes the skimmer cover of U.S. Pat. No. 5,285,538 difficult to remove from the face plate.

SUMMARY OF THE INVENTION

The skimmer cover of the present invention solves the removal problem discussed above. The invention provides a cover made from a flexible plastic material which includes a planar body portion and carries a sealing lip around its periphery. The cover may be square or rectangular in shape and includes an outwardly curved or radiused protruding section along one of its flat sides. The protruding section is co-planar with the body and also carries a sealing lip therearound. A lift tab is integrally molded to the protruding section to provide a gripping means for the user. A skimmer face plate has a conventional opening therethrough to permit the flow of pool water into the skimmer. The skimmer plate of the invention carries a peripheral flange around its outside edge which extends from its flat outside surface to lockably engage the integral sealing lip of the cover. The skimmer plate also has a protruding section which bears against the flat surface of the protruding section of the skimmer cover when the sealing lip of the cover is snapped in place around the flange of the skimmer face plate. In order to remove the cover from the face plate of the skimmer opening, the lift tab is grasped and lifted in a direction away from the face plate. This movement causes the curved protruding section of the cover to break its seal to permit water to enter between the protruding section so as to equalize the pressure on both sides of the cover in the area of the protruding section. Further movement of the lift tab and protruding section causes the seal to break along the periphery of the cover. The functional attributes and advantages of the invention will become more apparent when reference is made to the drawings taken with the following detailed description of a presently preferred embodiment of the invention.

DETAILED DESCRIPTION OF THE INVENTION

Figure 1:
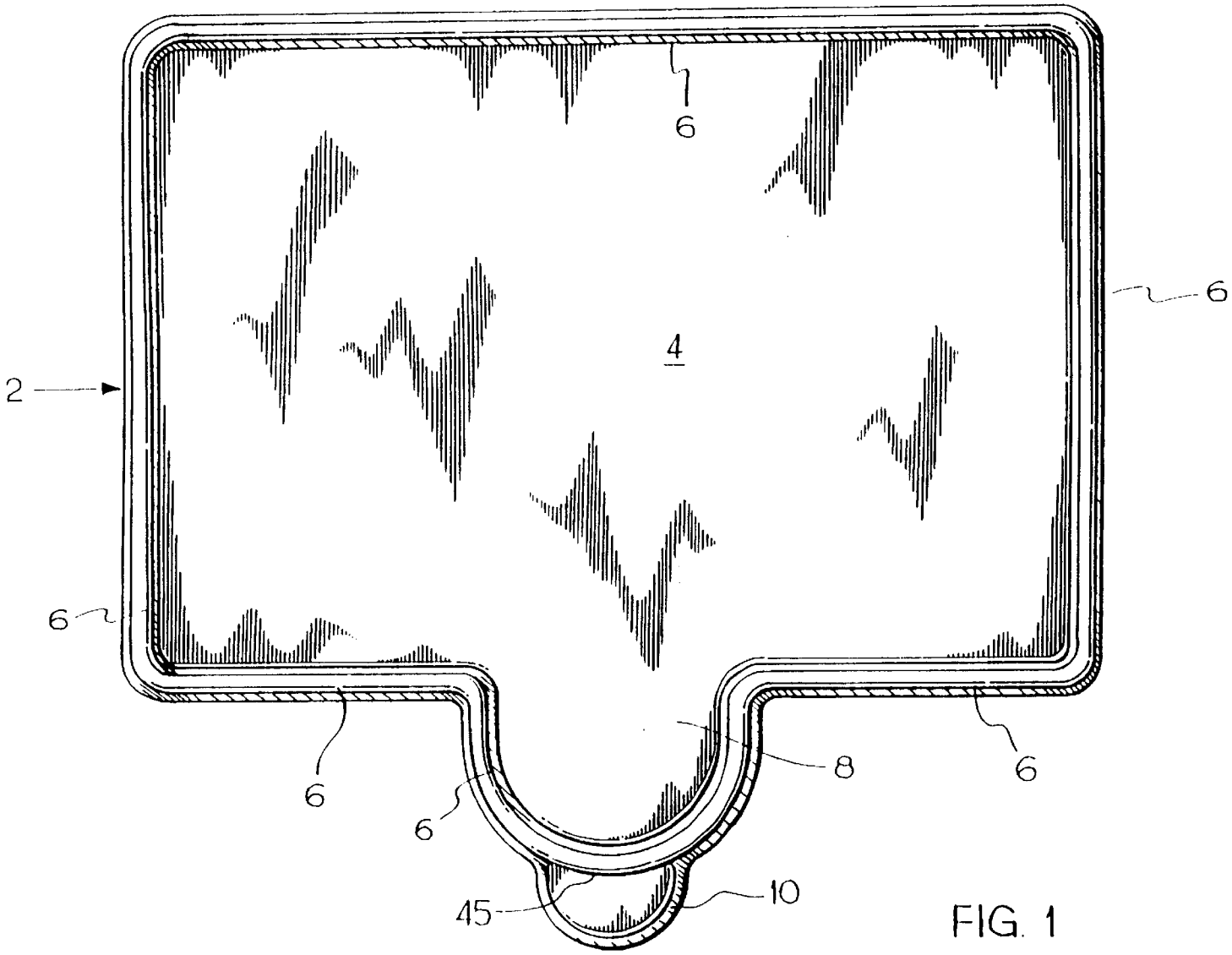
FIG. 1 is a plan view of the skimmer cover of the present invention.

The improved skimmer plate cover of the present invention is shown on the attached drawings and identified as element 2 thereon. FIG. 1 depicts the cover 2 alone. The cover 2 is molded from a thermoplastic material which is tough and flexible, such as injection molded nylon, polypropylene or the like. The cover 2 comprises a flat planar body portion 4 which is bounded around its sides by an integral sealing lip 6. The lip carries a beveled or raised protrusion 20 thereon to effect a locking engagement with a raised lip 22 of the face plate, FIG. 3.

The cover 2 is square or rectangular in shape and includes an outwardly protruding section 8 along one of the sides. The protruding section 8 also carries the integral sealing lip 6' therearound. A lift tab 10 is integrally molded to the protruding section 8.

Figure 2:
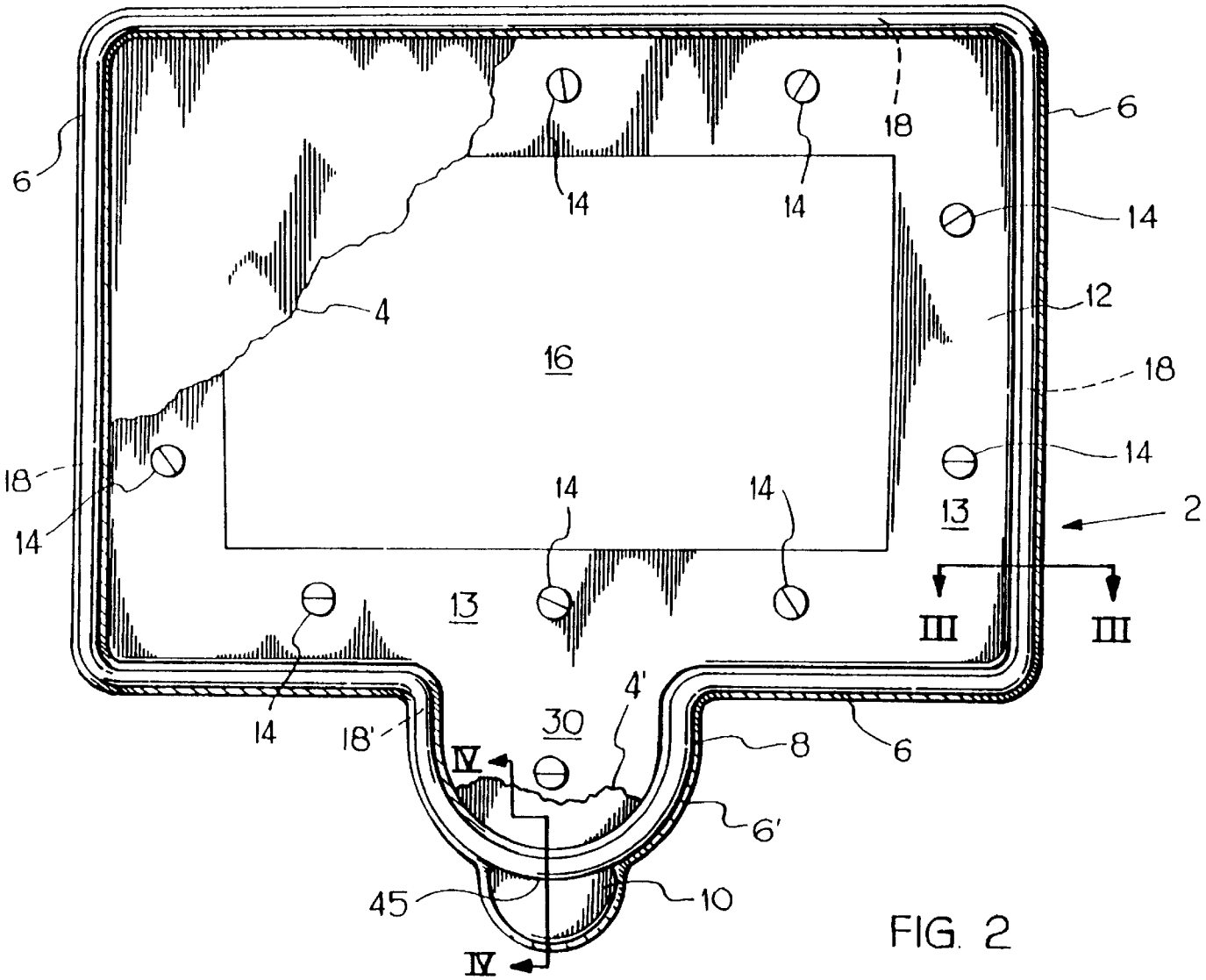
FIG. 2 is a partially broken away plan view of the skimmer cover and skimmer face plate of the present invention.

The use and function of the improved cover 2 of the invention will be better understood with reference to FIG. 2 which shows the cover 2 snapped in place on a modified and improved skimmer face plate 12. In FIG. 2, it will be noted that the planar portion 4 of the cover 2 is partially cut away from the peripheral sealing lip 6 so as to permit a view of the underlying skimmer face plate 12.

The skimmer face plate 12 is attached to a conventional skimmer body (not shown) at the sidewall of a swimming pool, spa, hot tub or the like in a known manner. The face plate 12 is held in place by a plurality of spaced apart screws 14 which engage threaded holes in the skimmer body positioned on the outside or exterior side of the pool wall. The face plate 12 is, of course, positioned on the inside pool sidewall. The skimmer plate 12 includes a flat surface or border 13 surrounding a central opening 16 therethrough which permits the flow of pool water into the skimmer body. The water is then recirculated and filtered through appropriate piping pump and filter apparatus for return to the pool in a known manner when the pool, spa or the like is open and in use.

Figure 3:
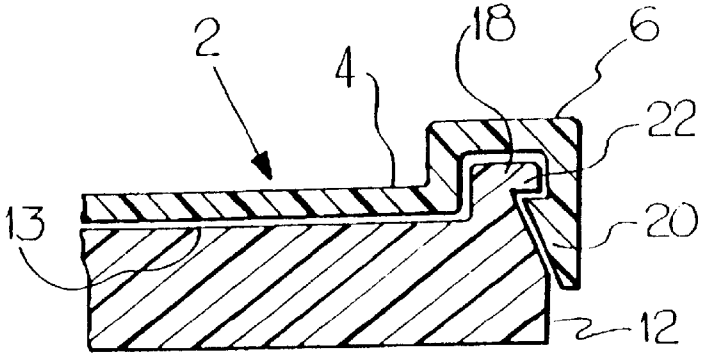
FIG. 3 is a partial cross-sectional side view of the lip of the cover and flange of the skimmer face plate of the invention in sealing engagement taken along line III—III of FIG. 2.

FIG. 3 is a partial cross-sectional view taken along section line III—III of FIG. 2 showing the sealing edge of the cover 2 and face plate 12 in detail. The improved skimmer face plate 12 has a frame-like shape and carries a peripheral bead or flange 18 around its outside edge. The flange 18 outwardly extends from the flat outer surface 13 of the frame-like border to lockably engage the integral sealing lip 6 of the cover 2. The lip 6 of the cover 2 carries a raised bead portion 20 which snaps around a rigid notched or raised portion 22 carried by the flange 18 of the skimmer plate 12. The flexible nature of the thermoplastic lip 6 permits this snapping action to take place which locks the cover 2 tightly around the face plate 12 to provide a water-tight seal.

Figure 4:
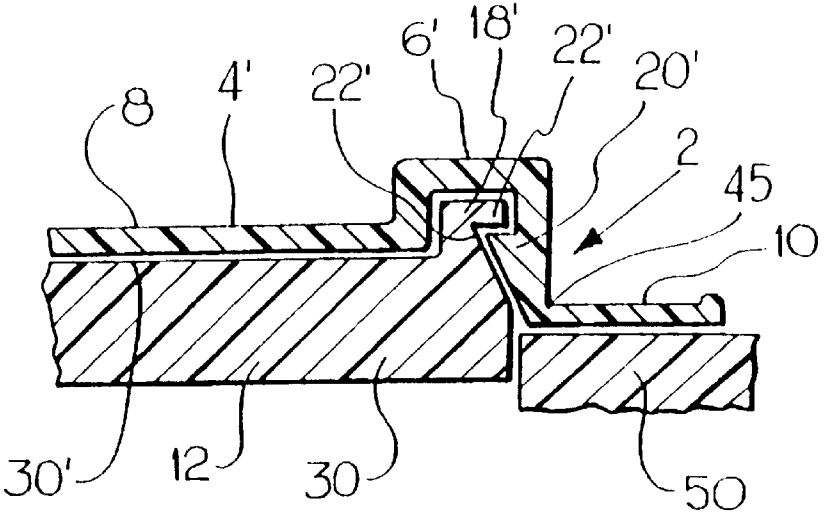
FIG. 4 is a partial cross-sectional side view of the protruding section and lift tab of the skimmer cover and skimmer face plate of the invention in sealing engagement taken along line IV—IV of FIG. 2.

FIG. 4 is a cross-sectional view taken along section line IV—IV of FIG. 2 to show in greater detail the area of the protruding section 8 of the skimmer cover 2. The improved skimmer plate 12 also has a curved or radiused protruding section 30 which extends outwardly from one side of the skimmer plate, and includes an upper surface which is co-planar and continuous with the flat border surface 13 of the skimmer plate, FIG. 2. The protruding section 30 has a peripheral flange 18' shown in FIG. 4 which lockably engages a sealing lip 6' of the curved or radiused protruding section 8 of the cover 2. The flange 18' is continuous with the peripheral flange 18 of the skimmer plate 12 and the sealing lip 6' is continuous with the peripheral sealing lip 6 of the cover 2 so as to insure a continuous water-tight seal around the periphery of the cover.

The lift tab 10 extends outwardly from the protruding section 8 of the cover and from the periphery of the skimmer plate 12 to overlay the pool sidewall 50. A planar portion 4' of the protruding section 8 of the cover is continuous with the planar portion 4 and closely engages the flat surface 30' of the protruding section 30 of the skimmer plate 12 as shown in FIG. 4.

In the springtime, for example, when the level of water has risen above the skimmer cover 2, it becomes necessary to remove the skimmer cover when the pool is to be opened for the swimming season. In order to easily remove the cover 2, the tab 10 is grasped and moved away from the pool wall 50. By way of example, the lift tab 10 may be about ¾ inch long and about 1½–1¾ inches wide at its joint with the protruding section 8. The length of the tab 10 provides a good lever effect about the sealing lip 6' to permit the flexible lip and protrusion 20' to unsnap from the rigid raised lip 22 of the flange 18' of the skimmer plate.

The generous width of the tab 10 along the joint area 45 provides adequate strength and prevents tearing or rupture of the thermoplastic material when removal forces are applied thereto. The thickness of the lift tab 10 is about 0.064 inch, for example, which also provides suitable strength. The overall dimension of the cover may be on the order of 11 inches long by 8 inches wide in the rectangular plan view with the protruding section 8 extending outwardly therefrom about 2½ inches. It will be readily appreciated that the cover 2 presents a surface area of about 90 square inches which, when submerged any appreciable depth in water, will require a considerable force to overcome the water loading. In addition, the snap fit between the sealing lip of the cover and the flange of the skimmer plate produces a very strong union which is difficult to disengage without the aid of the tab 10 and the curved protruding section 8.

As the tab 10 is pulled away from the pool wall 50 and the seal is broken between the sealing elements 20' and 22' of the cover and skimmer plate, respectively, water will flow into the opened seam. As can be appreciated from FIG. 4, the water will then enter the area between the planar surfaces 30' and 4' of the respective protruding sections 30 and 8 of the skimmer plate 12 and cover 2. When this water entry occurs, the pressure will equalize between the areas inside and outside the cover 2. Thus, removal of the cover 2 is greatly facilitated by virtue of the pressure equalizing feature provided by the cooperating protruding sections 30 and 8 of the skimmer plate and cover, respectively. The lever effect of the lift tab 10 also provides a means for easily breaking the tight seal to permit entry of the water between the cover and the skimmer.

The above-described arrangement also provides a reusable skimmer cover arrangement by virtue of its configuration. The curved protruding section 8 and lift tab 10 extend the stresses generated during removal over a large area to prevent tearing of the sealing lip 6. Thus, reuse of the cover 2 for many seasons is possible.

While a specific embodiment of the invention has been described in detail, it will be appreciated by those skilled in the art that various modifications and alternatives to those details could be developed in light of the overall teachings of the disclosure. The presently preferred embodiment described herein is meant to be illustrative only and not limiting as to the scope of the invention which is to be given the full breadth of the appended claims and any and all equivalents thereof.

We claim:

1. A skimmer cover assembly for a swimming pool skimmer comprising:

a face plate for mounting around a skimmer opening in a sidewall of a swimming pool, said face plate including a frame-like member defining a central opening therein for communication with the skimmer opening in the sidewall of the swimming pool, said face plate having a substantially flat border surface extending around the central opening and including sealing flange means extending around a peripheral edge thereof, said face plate also including a first protruding section outwardly extending from and co-planar with the flat border surface, said first protruding section also having sealing flange means including a rigid, raised lip extending around a peripheral edge thereof;

a detachable, reusable cover made from a flexible material comprising a planar central portion for selectively closing off the central opening in the face plate, said cover element further including a peripheral lip having a raised portion which is adapted to snap around the rigid, raised lip of the face plate for sealably engaging the sealing flange means around the face plate to prevent water from entering the skimmer opening, said cover further including a second protruding section extending outwardly from a peripheral edge of said cover and substantially co-planar with the planar central portion of the cover for bearing engagement against the planar surface of the first protruding section of the face plate, said second protruding section having a peripheral lip for sealably engaging the flange means of the first protruding section of the face plate; and a gripping tab means integral with the protruding section of the cover for separating the peripheral lip of the protruding section of the cover by way of a lever effect from the flange of the protruding section of the face plate.

2. The skimmer cover assembly of claim 1 wherein the cover is molded from a plastic material selected from the group consisting of nylon and polypropylene.

* * * * *